US005359935A

United States Patent [19]

Willett

[11] Patent Number: 5,359,935

[45] Date of Patent: Nov. 1, 1994

[54] DETONATOR DEVICE AND METHOD FOR MAKING SAME

[75] Inventor: John D. Willett, Princeton, Mass.

[73] Assignee: Applied Energetic Systems, Inc., Princeton, Mass.

[21] Appl. No.: 16,591

[22] Filed: Jan. 13, 1993

[51] Int. Cl.[5] ..... F42B 1/02; F42B 3/00

[52] U.S. Cl. ..... 102/307; 102/312; 102/313; 299/13

[58] Field of Search ..... 102/307, 312, 313; 175/4.51; 299/13

[56] References Cited

U.S. PATENT DOCUMENTS

| | | | |
|---|---|---|---|
| 2,725,821 | 12/1955 | Coleman | 102/22 |
| 3,902,422 | 9/1975 | Coursen | 102/23 |
| 4,018,163 | 4/1977 | Brown | 102/23 |
| 4,406,226 | 9/1983 | Davitt et al. | 102/311 |
| 4,770,097 | 9/1988 | Wilson et al. | 102/312 |
| 4,892,039 | 1/1990 | Emerson et al. | 102/476 |
| 4,896,609 | 1/1990 | Betts et al. | 102/310 |
| 4,915,029 | 4/1990 | Appledorn et al. | 102/310 |
| 4,960,171 | 10/1990 | Parrott et al. | 166/55 |

*Primary Examiner*—Peter A. Nelson

*Attorney, Agent, or Firm*—Hayes, Soloway, Hennessey, Grossman & Hage

[57] ABSTRACT

A device for generating a shockwave for initiating detonation of a main explosive charge and a method for producing same are provided. A device according to the instant invention is capable of producing a more planar wave front than is possible according to the prior art. Also, the wave front generated by such a generator flattens out in less time than in the prior art, and therefore the weight and axial length of a warhead equipped with a generator according to the instant invention may be substantially reduced without a corresponding reduction of the detonator's explosive yield.

21 Claims, 8 Drawing Sheets

DETONATOR DEVICE AND METHOD FOR MAKING SAME

BACKGROUND OF THE INVENTION

Field of the Invention

The present invention relates generally to an explosive detonator device and a method for fabricating same. More specifically, the present invention relates to an improved device for generating a substantially planar shockwave for impinging upon and detonating an explosive charge, and to a method for making same.

It has long been known that the shape of the wave front used to initiate detonation of a shaped charge warhead plays a major role in determining the magnitude of explosive force jetting behavior resulting therefrom. In particular, it is known that, in theory, a planar detonation shockwave front is capable of maximizing explosive yield performance in such shaped-charge-containing warheads. Accordingly, the prior art has attempted to provide detonators capable of producing planar shockwave detonation fronts, the most successful of which will be presently detailed.

Two such prior art devices are the explosive lens and the air lens which use Baratol-containing materials and metallic flyer plate, respectively, to appropriately channel explosive force to form planar shock wave fronts. Each of these devices, however, produce shock wave fronts which require a significant amount of propagation time, and therefore, a significant amount of propagation distance (run distance), to achieve substantial planarity. This necessitates the lengthening of a warhead containing either of these two devices, so as to provide the necessary run distance (in the air lens case) within the warhead to permit the wave front generated to settle out prior to impinging upon the shaped charge liner. Thus, a warhead which incorporates either of these two devices must be longer and heavier than is desirable.

Another such prior art detonation initiator is the four-fold axisymmetric plane wave generator, which consists of a substrate with multiple, equal length grooves connected to multiple through-holes in the substrate. The multiple through-holes are grouped into four clusters centered around a common origin located at or near the center of the device. The grooves, through-holes and other void space in the substrate are filled with an explosive material. When a suitable initiation stimulus, from an electric blasting cap, is applied to the common origin, the explosive material therein detonates and the explosive force is transferred out along the grooves to the through-holes. Although this device is capable of producing a near-planar shockwave, that shockwave is subject to extremely large un-controllable pressure discontinuities along its direction of propagation. As a result, when this device is used to detonate a shaped-charged warhead the jetting performance obtained is marginal at best.

Yet another prior art detonator capable of generating a shaped shockwave is disclosed in Emerson et al, U.S. Pat. No. 4,892,039. The Emerson device comprises inner and outer conically shaped members with the outer conically shaped member having the shape of a modified frustum of a cone due to a cylindrical member extending from the smaller base of the outer conically shaped member. A space between the inner and outer conically shaped member contains an explosive material which can be discharged after ignition as a shockwave in a ring-like (annular) configuration. This device is said to produce a flatter wave front per unit length than otherwise possible, so as to be able to achieve improved explosive yield in the main charge and to permit the use of a warhead having a shorter axial length.

Unfortunately, the wave front generated by the Emerson device requires substantial propagation distance to achieve planarity. As has been described previously, this necessitates a significant increase in the axial length of the warhead and wastes warhead space that could otherwise be used to contain other features (for example, guidance electronics). Also, it has been found that the Emerson device may, under some conditions, fail to function properly. This is due to the fact that upon initiation of the explosive within the channel between the inner and outer members of the Emerson device, substantial explosive force is applied to the inner conical member. This condition may result in the collapse of the inner member, and thereby, in the failure of the device to produce the desired, substantially planar detonation wave front.

Yet another example of a prior art shaped-wave detonator is disclosed in U.S. Pat. No. 4,896,609, issued to Betts, et al.

OBJECTS OF THE INVENTION

It is a general objective of the present invention to provide a detonation device that eliminates all the drawbacks found in the prior art, and specifically, to provide a detonator device that is capable of producing a substantially planar shock wave front that is not subject to un-controllable large pressure discontinuities along its direction of propagation, and which produces a wavefront that achieves planarity faster than the prior art, thereby permitting the axial length and, thus, the weight of a warhead incorporating the device to be significantly reduced.

It is another object of the instant invention to provide a method for producing a detonator capable of meeting the foregoing objectives.

SUMMARY OF THE INVENTION

Accordingly, in one aspect of the instant invention, a detonator device capable of producing a substantially planar shockwave for initiating detonation of an explosive main charge is provided. A detonator according to this aspect of the present invention comprises a substrate having two surfaces. One of the two surfaces has a detonation initiation point and three identically configured clusters of either fifteen or twenty-four through-holes each. The groups of through-holes are symmetrically disposed in the detonator's substrate about the initiation point and are connected via a plurality of grooves and/or channels of substantially equal length to the initiation point. The grooves, initiation point, and through-holes are filled with an explosive material.

In a preferred embodiment, each of the through-holes is conically shaped to form a plurality of output points counter-sunk on the opposite side of the substrate.

Advantageously, a detonator made according to this first aspect of the instant invention is capable of producing a shockwave of greater planarity than was heretofore possible, for impinging upon and detonating a explosive main charge. Further advantageously, the wave front produced by a detonator made according to the instant invention flattens out faster than those made according to prior art, allowing the weight and axial length of a warhead equipped with a detonator according to the instant invention to be substantially reduced when compared to the prior art.

In a second aspect of the present invention, there is provided a method for forming a detonator device according to the first aspect of the present invention. In general, such a fabrication method according to the present invention comprises the steps of forming in a substrate a plurality of through-holes. According to the instant invention, the plurality of through-holes are formed in the substrate so as to be configured into three identical clusters of through-holes, each cluster having a predetermined number of through-holes each. The clusters are symmetrically disposed in the substrate about an arbitrary axis which defines the origin of a 2-dimensional coordinate system for one surface of the substrate. Then, according to the present invention, a plurality of grooves of substantial equal lengths are formed in this one side of the substrate. These grooves connect the through-holes of the clusters to an initiation point which is disposed in the substrate and is coaxial with the arbitrary axis of the one surface.

While the present invention will hereinafter be described in connection with preferred embodiments thereof, it will be understood that is not intended to limit the invention to these embodiments. On the contrary, it is intended to cover all alternatives, modifications, and equivalents as may be included within the spirit and broad scope of the invention as defined only by the appended claims.

BRIEF DESCRIPTION OF THE DRAWINGS

Reference should now be had to the following Detailed Description of preferred embodiments of the instant invention, taken in conjunction with the accompanying drawings, wherein like numerals represent like parts and in which.

DESCRIPTION OF THE PREFERRED EMBODIMENT

Figure 1:
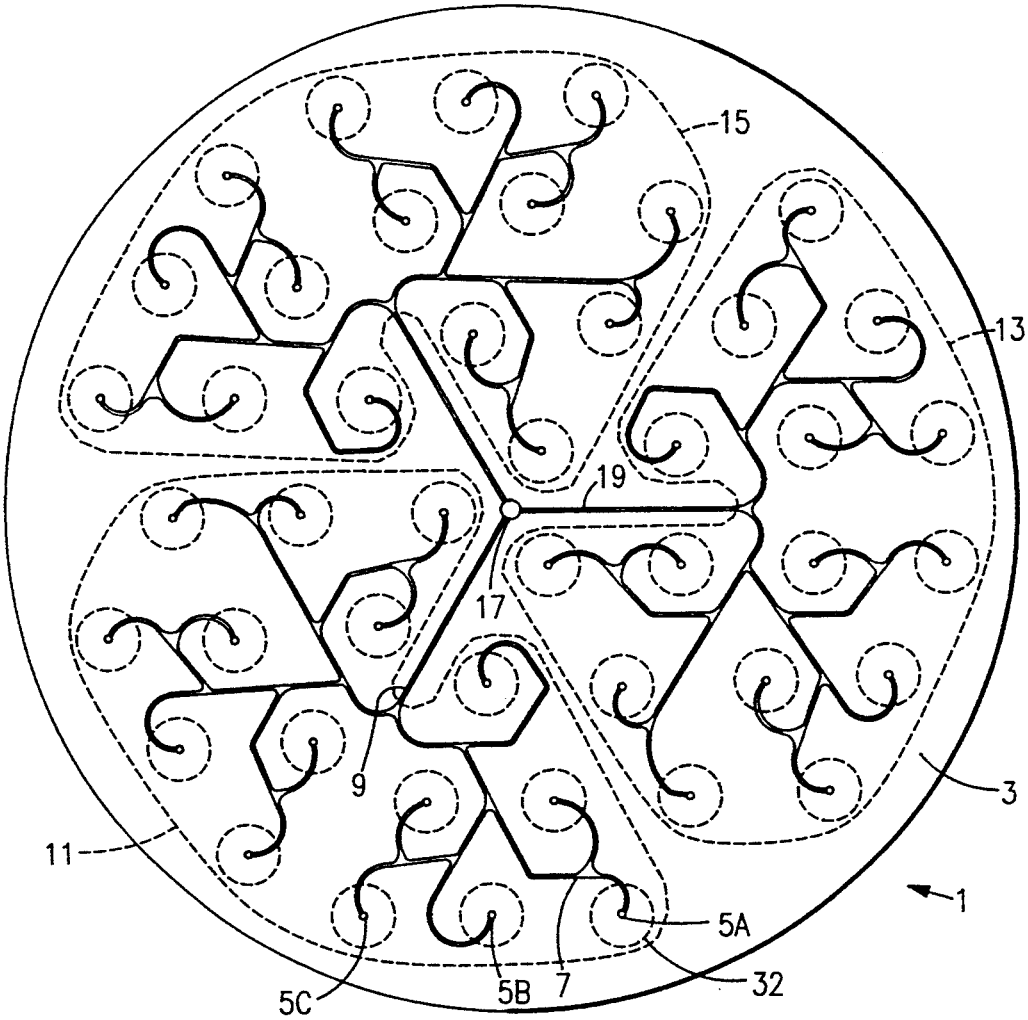
FIG. 1 is a rear view of a preferred embodiment of a detonator made according to the first aspect of the instant invention.
Figure 3:
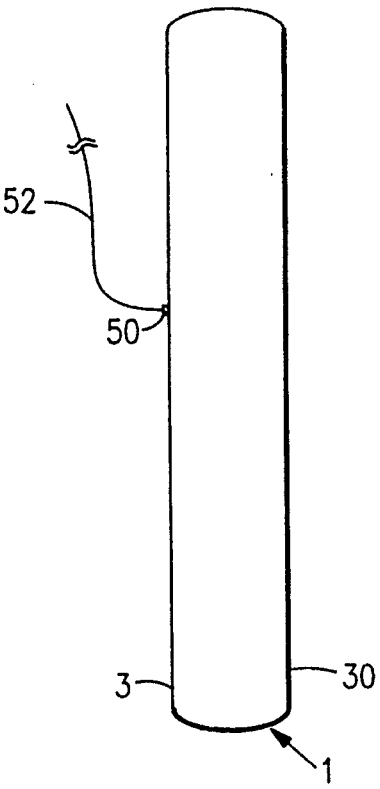
FIG. 3 is a side view of the detonator depicted in FIGS. 1 and 2.

With reference to the Figures of the Drawings and specifically to FIG. 1, a detonator made according to the instant invention comprises a substrate 1 having front 30 and rear 3 surfaces. Preferably, the substrate 1 is made of a polycarbonate material and has a disk-like shape, but other suitable materials and shapes may be used without departing from the instant invention, as will be apparent to those skilled in the art. Disposed in the rear 3 surface of the substrate 1 are a plurality of substantially equal length grooves and/or channels (one such groove is referred to by numeral 7) connecting a plurality of through-holes (three of which are referred to by numerals 5A, 5B and 5C) and an initiation point 17. These grooves may be formed in the rear 3 surface of the substrate using any conventional method, including injection molding, precision etching and/or machining methods. Preferably, the initiation point is located at or near the center of the substrate. Also, according to the instant invention the grooves, through-holes, and the initiation point are filled with a conventional explosive material (not shown).

Figure 2:
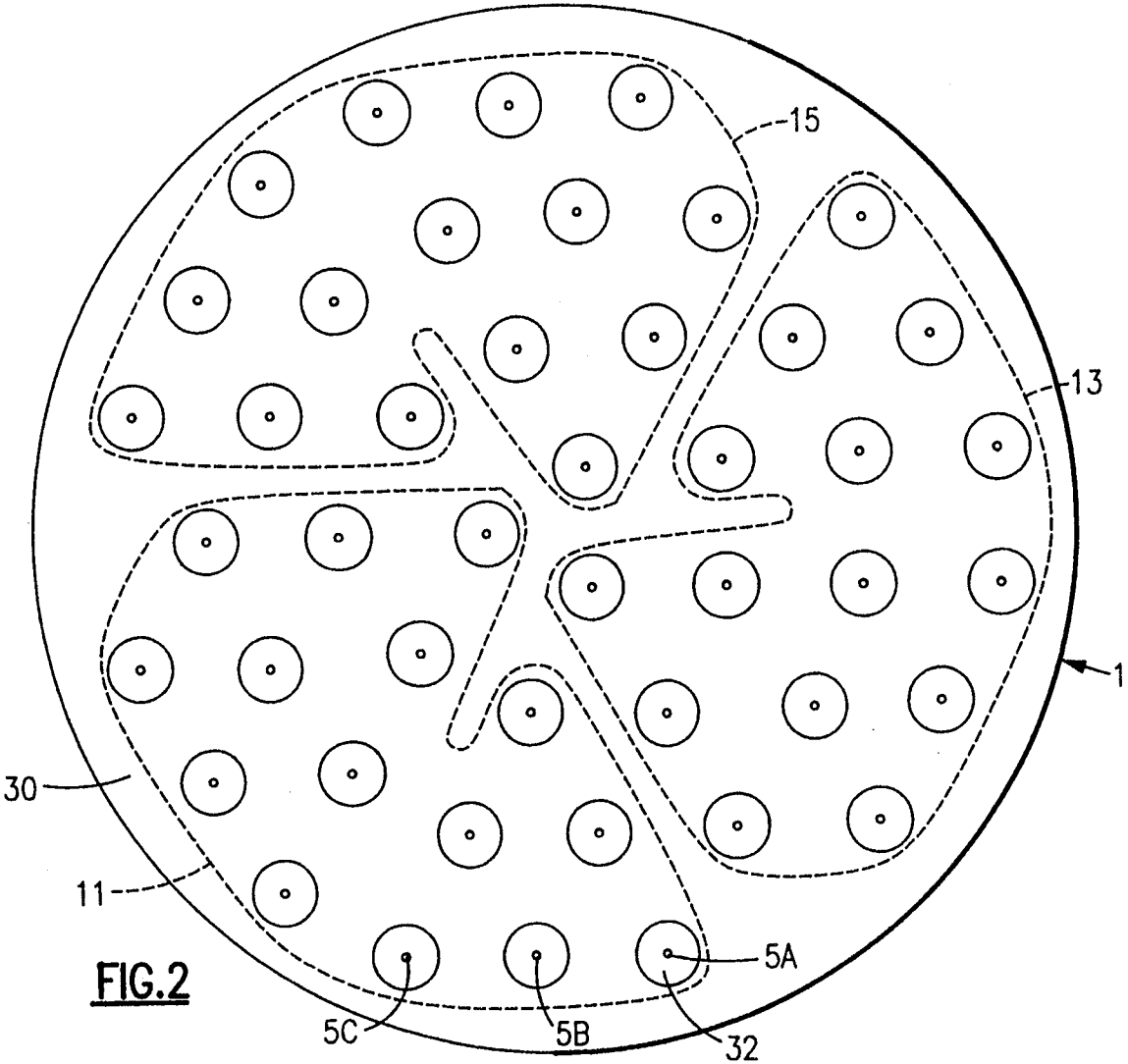
FIG. 2 is a frontal view of the detonator depicted in FIG. 1.
Figure 4:
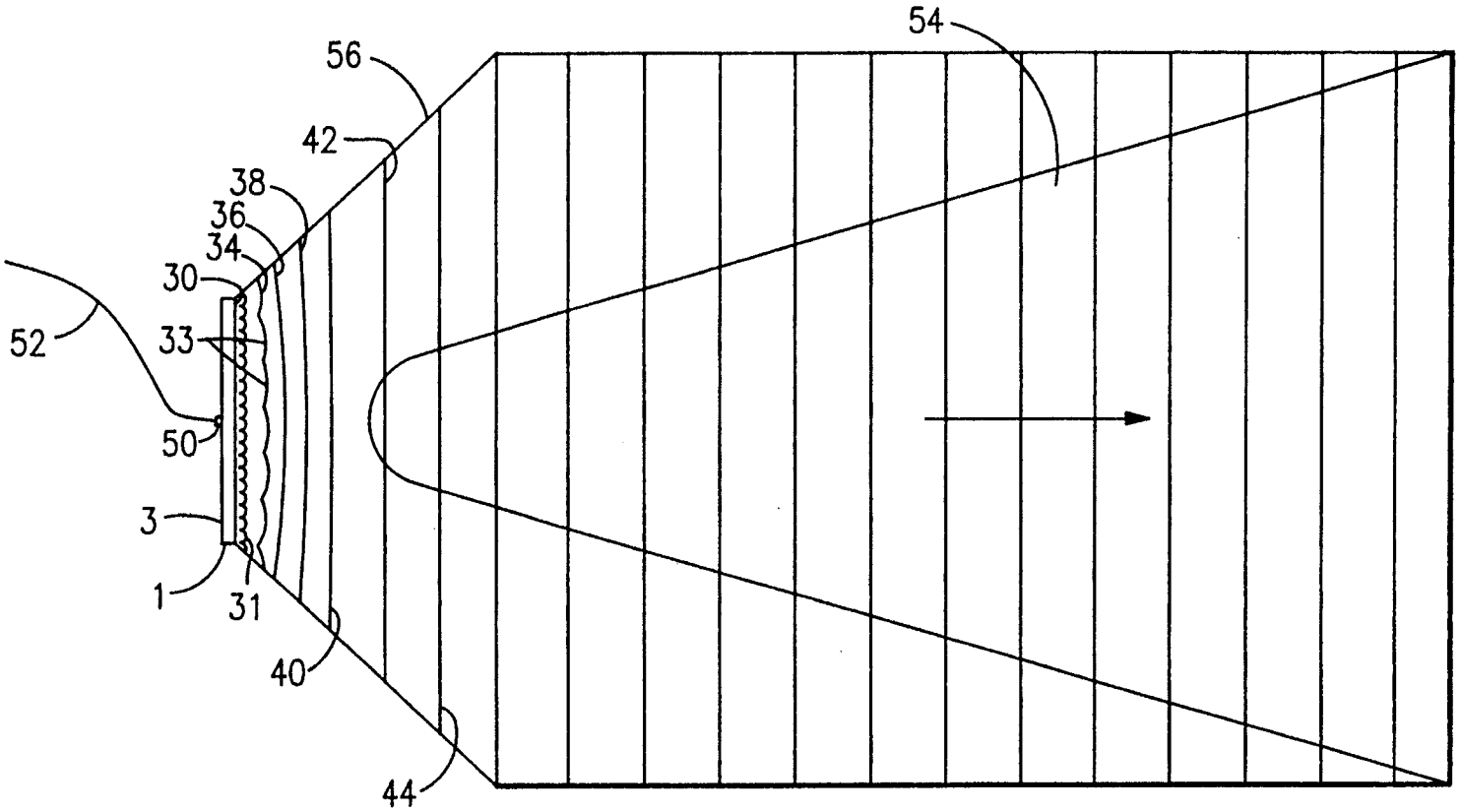
FIG. 4 illustrates a conventional warhead design in combination with one embodiment of the detonator device of the instant invention generating a shockwave.
Figure 5:
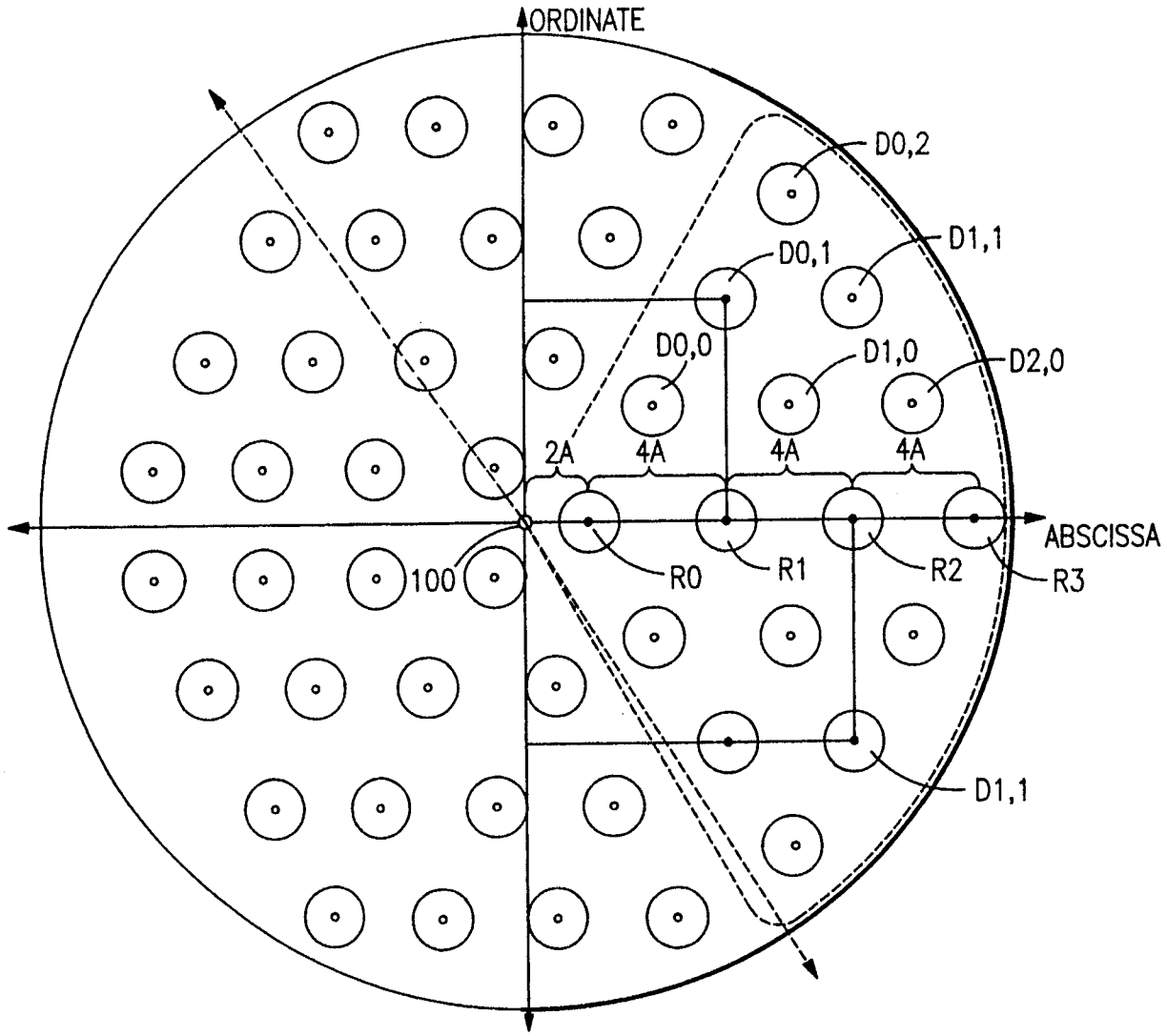
FIG. 5 is an illustration of a preferred embodiment of a detonator device according to the instant invention, in which relationships among various elements of the device have been illustrated so as to facilitate discussion of a preferred embodiment of the method according to the second aspect of the instant invention for forming the device according to the first aspect of the instant invention.
Figure 6:
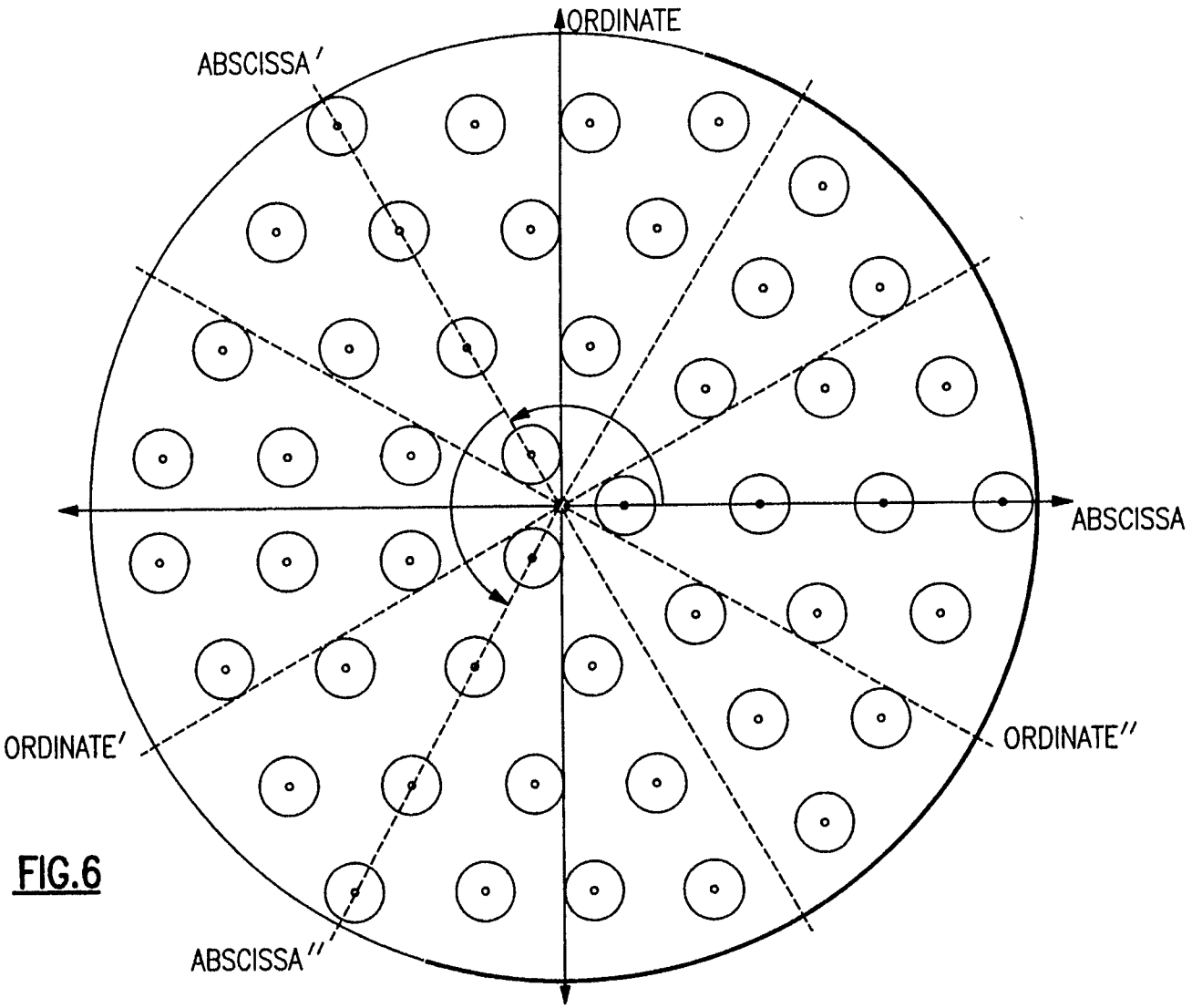
FIG. 6 is an illustration similar to that of FIG. 5, in which the illustration of FIG. 5 has been modified to facilitate further discussion of the preferred method whose discussion is facilitated by FIG. 5.

The through-holes 5A, 5B, and 5C, are arranged so as to form three identically configured clusters, outlined by dotted-lines 11, 13, and 15. These clusters 11, 13 and 15 are disposed (in the manner shown in FIGS. 1 and 2) in the substrate 1 such that they are axially symmetric about an axis 100 which is normal to the surface 3 and coaxial with the initiation point 17. Preferably, the through-holes have a conical-shape so as to form nozzle-like structures. In the embodiment depicted in FIGS. 1 and 2, each of the plurality of through-holes has this conical shape, that is, the radius of a given through-hole in the rear surface 3 of the substrate 1 is less than its radius in the front 30 surface of the substrate and increases continuously from the rear surface 3 to the front surface 30. This forms a plurality of countersunk output points one of which is referred to by numeral 32.

Also according to various respective embodiments of the instant invention, the number of through-holes in the substrate may be 45 (three identically configured groups of 15 through-holes each) or 72 (three identically configured groups of 24 through-holes each). Preferably the three identical axially symmetric groups of through-holes are connected to the initiation point 17 by three identical main channels 19, 21 and 23, respectively.

With reference now to FIGS. 1–4, a preferred method for using a detonator made according to the instant invention will be presently detailed. Upon initiation by suitable stimulus 50, which may be provided by electrical, electromechanical, a primer, or other suitable means, of the explosive material contained in or adjacent to the initiation point 17 the resulting detonation is channeled through, preferably, the equal-length main channels 19, 21 and 23 and into the plurality of grooves 7. The detonation is then channeled through the through-holes (preferably taking the form of the nozzle-shaped counter-sunk output points 32) and out from the front 30 surface of the substrate 1. The detonation exiting the front surface 30 thus forms shockwave front 31 having a plurality of ripples 33 emanating from the output points 32 on the front 30 surface of the substrate 1. As the wave front expands over time along its direction of propagation (denoted by the arrow in FIG. 4), the ripples 33 begin to merge to form intermediate, flatter wave fronts 34, 36, 38 and 40. This flattening of the wave front over time results from several factors: the substantially simultaneous emanation of each of the individual wavefronts or ripples 33 from the output points, the axially symmetric configuration of the through-holes, and the substantially equal length of each individual groove. Each of these factors contributes to making the propagation time and magnitude of the explosive energy channelled from the initiation point to each of the individual output points substantially identical.

Finally, the wavefront flattens out to become the substantially planar-shaped wave fronts 42 and 44 prior to impinging on the shaped charge liner 54, which preferably is a metallic polymeric, or other suitable material contained within, in this case, a warhead 56. Of course, it will be understood by those skilled in the art that a device according to the instant invention may be used effectively to detonate main explosive charges having other than cylindrical geometries. Preferably, as will be understood by those skilled in the art, the axial length of the main explosive in a shaped charge warhead is sufficient to permit substantial planarity of the wave front generated by the device to exist prior to impinging on the liner. Also, the type of explosive used to form the main charge and contained within the void spaces of the substrate 1 may be any type of conventional explosive, depending on the needs of the particular application, as will be apparent to those skilled in the art. Moreover, the types of explosive used to form the main charge and to fill the void spaces of the substrate may be dissimilar from each other.

Turning presently to FIGS. 1–7, a preferred method, according to the second aspect of the instant invention, for constructing a second preferred embodiment of a device according to the first aspect of the instant invention will be described. As stated previously, in general, a method for producing a detonator device according to the instant invention comprises forming, in the substrate 1, the plurality of through-holes 5*a*, 5*b*, and 5*c*, the initiation point, and the plurality of grooves connecting the initiation point to through-holes so as to permit the channeling of the detonation from the initiation point, upon detonation thereof, to each of the plurality of through-holes, and thence, out of the through-holes to form a wave front for impinging, and thereby detonating, a main explosive charge. Also as stated previously, the through-holes formed in the substrate are configured, according to the instant invention, into three identical clusters having a predetermined number of through-holes each, which are symmetrically disposed in the substrate about an arbitrary axis normal to the surface 3 of the substrate 1. More specifically, using FIGS. 6 and 7, a preferred embodiment of a method according to the second aspect of the instant invention (for producing this second preferred embodiment of a detonator device according to the first aspect of the instant invention) will be presently described.

First, in this preferred embodiment, an arbitrary axis 100 (shown in dashed lines) is chosen. Preferably, this axis 100 is chosen so as to intersect the substrate 1 at or near the center thereof. A two-dimensional coordinate system having an ordinate and abscissa may then be defined based on the intersection of the arbitrary axis 100 chosen with the substrate 1. Of course, as will be appreciated by those skilled in the art, inasmuch as the location of the axis 100 is arbitrary, it may be positioned so as to intersect the substrate 1 anywhere along the surface 3 of the substrate 1 depending on the desired characteristics of the device to be formed. Next, the locations of a plurality of root holes $R_0$ . . . R4 are chosen, based on the arbitrary axis 100 and the coordinate system defined by it. The first through-hole $R_0$ is positioned so as to have its center substantially twice an arbitrary distance (denoted by 2A) away from the origin defined by the intersection of the axis 100 with substrate 1. Subsequent through-holes $R_1$ . . . R4 are then formed separated from the first through-hole $R_0$ and each other, R1 . . . R4 by a distance that is equal to four times the previously stated arbitrary distance (or twice the distance 2A that the first root hole $R_0$ is separated from the origin). There are a given number of root holes. Thus it will be appreciated that if a given root hole is assigned an order value N depending upon its order away from the origin (for example, $R_0$ has an order of zero; R1 has an order of 1, and so forth), then the distance from the center of any given root hole to the arbitrary origin 100 would be equal to $(2+4N)$ A (A representing the predetermined arbitrary distance). Thus, using the foregoing relationship, any number of root holes may be placed along the abscissa, the number of root holes being limited only by the radius of the substrate and the magnitude of the arbitrarily chosen distance A.

After determining, according to the foregoing steps, the locations for the root holes of the first group (denoted by the dashed lines in FIG. 6), the locations for the other holes may be determined. Each of the derived holes D0,0 . . . D2,0 is formed in the substrate in the first quadrant of the coordinate system so that, if reflected through the abscissa, each derived hole would coincide with another symmetrically situated derived hole (collectively referred to by D1,-1) located in the fourth quadrant of the coordinate system. The order of each of the derived holes is assigned so as to equal the order of the corresponding root hole to it along the abscissa. For the purposes of the instant description, a derived hole is considered to correspond to a root hole if the centers of the derived hole and the root hole are aligned so as to form a $\pm 60$ degree angle between a line drawn connecting the two centers and the abscissa. In the first quadrant, the angle formed by the line connecting the two centers and the abscissa has a measure of 60° while in the fourth quadrant, that angle is $-60°$. Further, preferably, the derived holes are located in the substrate such that, if an order M is assigned to each root hole ranging from 0 (for the derived holes located nearest its corresponding root holes) to Y (for the derived holes located farthest away from its corresponding root hole), the distance from the center of a given derived hole to the abscissa of the coordinate system substantially satisfies a second relationship, $4A(M+1)\mathrm{Sin}(T)$, wherein T equals either 60° (for a derived hole located in the first quadrant) or minus $-60°$ (for a derived hole located in the fourth quadrant). Additionally, each derived hole is located so that the distance from the center of a given derived hole to the ordinate of the coordinate system substantially satisfies a third relationship, $(4N+2M+4)$ A. As in the case of the root holes, it will be appreciated that any number of derived holes may be placed in the substrate, depending on the arbitrary distance A chosen and the radius of the substrate 1, so long as the locations chosen for the derived holes, substantially satisfy the foregoing two relationships related thereto. Thus, using the foregoing steps according to this preferred method of the second aspect of the instant invention, the locations for each of the through-holes of one cluster of through-holes may be determined. Continuing this preferred method, positions for the other through-holes(in the other two clusters) may next be determined, by successively respectively twice rotating the ordinate and abscissa of the coordinate system by 120 degrees about the arbitrary axis 100 and by then repeating the foregoing steps for each of the two respective rotations to produce the second and third clusters respectively. Thereafter, the preferred method may continue, and the grooves connecting the initiation point to the through-holes may be formed.

Figure 7:
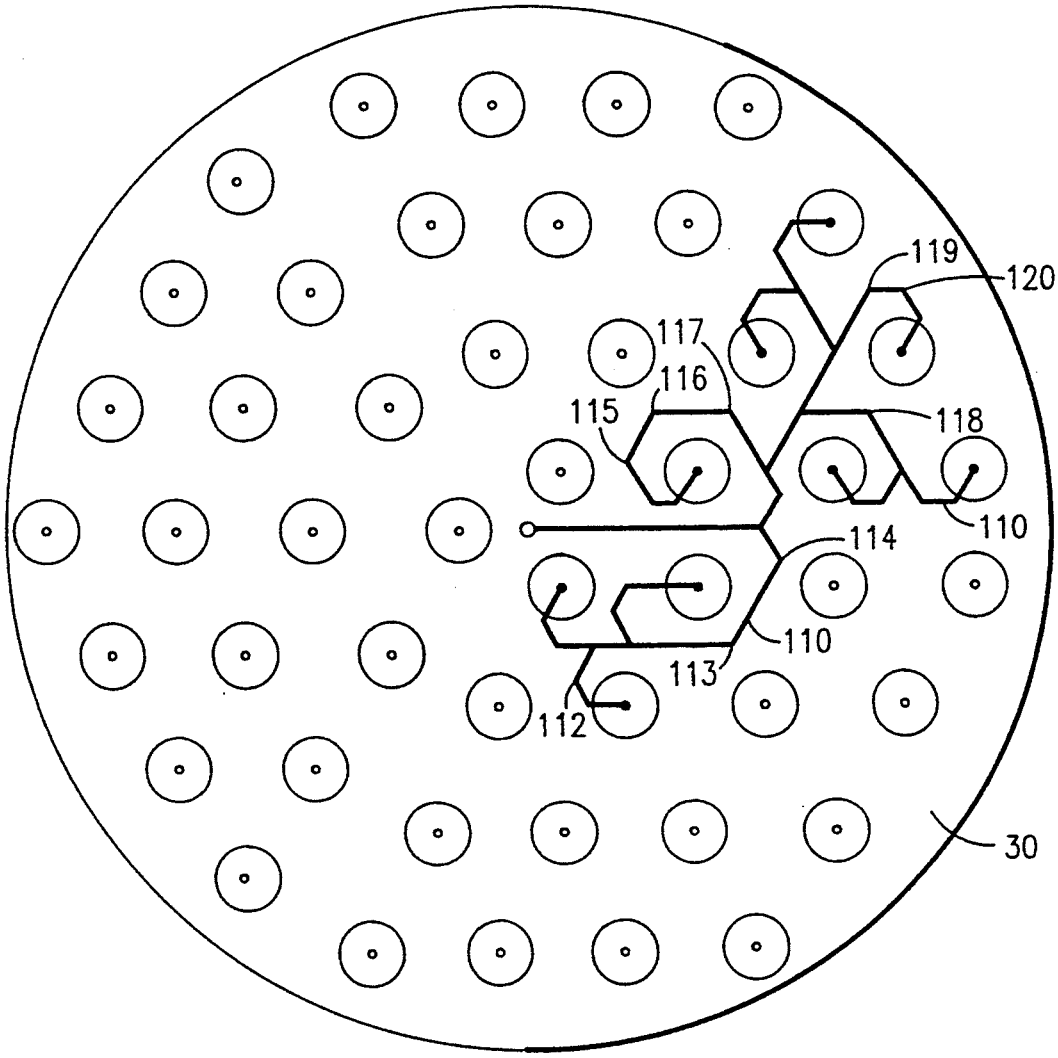
FIG. 7 depicts an embodiment similar to that of FIGS. 5 and 6, except that its has been modified to facilitate discussion of a preferred method for forming grooves and channel tracks.

With particular reference to FIG. 7, the preferred method for forming the channels and/or grooves connecting the initiation point to the plurality of through-holes in each cluster will now be described. Once the positions for each of the plurality of through-holes has been determined, rough groove tracks 110 may be formed on the one surface 30 of the substrate 1. Preferably, these rough tracks 110 are formed such that, in the direction of flow of explosive energy from the initiation point to the through-holes, the turn angle through which the energy flows is at least 90°. Also, according to the instant preferred method, all of the rough track patterns formed in the substrate must be of equal length (that is, the path length from the initiation point to any given through-hole must be substantially the same as the path length from the initiation point to any other through-hole. Each of the angled turns (some of which are referred to by numerals 112 . . . 120) of the rough tracks is then smoothed using any conventional method, and preferably comprises the precision etching injection molding and/or machining, of the jagged rough track angles to form the smoothed turns illustrated in FIG. 1. Lastly, according to this second aspect of the present invention, the void space of the substrate 1, including the initiation point, through-holes, grooves and channels may be filled with an explosive material, as has been described previously.

EXAMPLE

Figure 8:
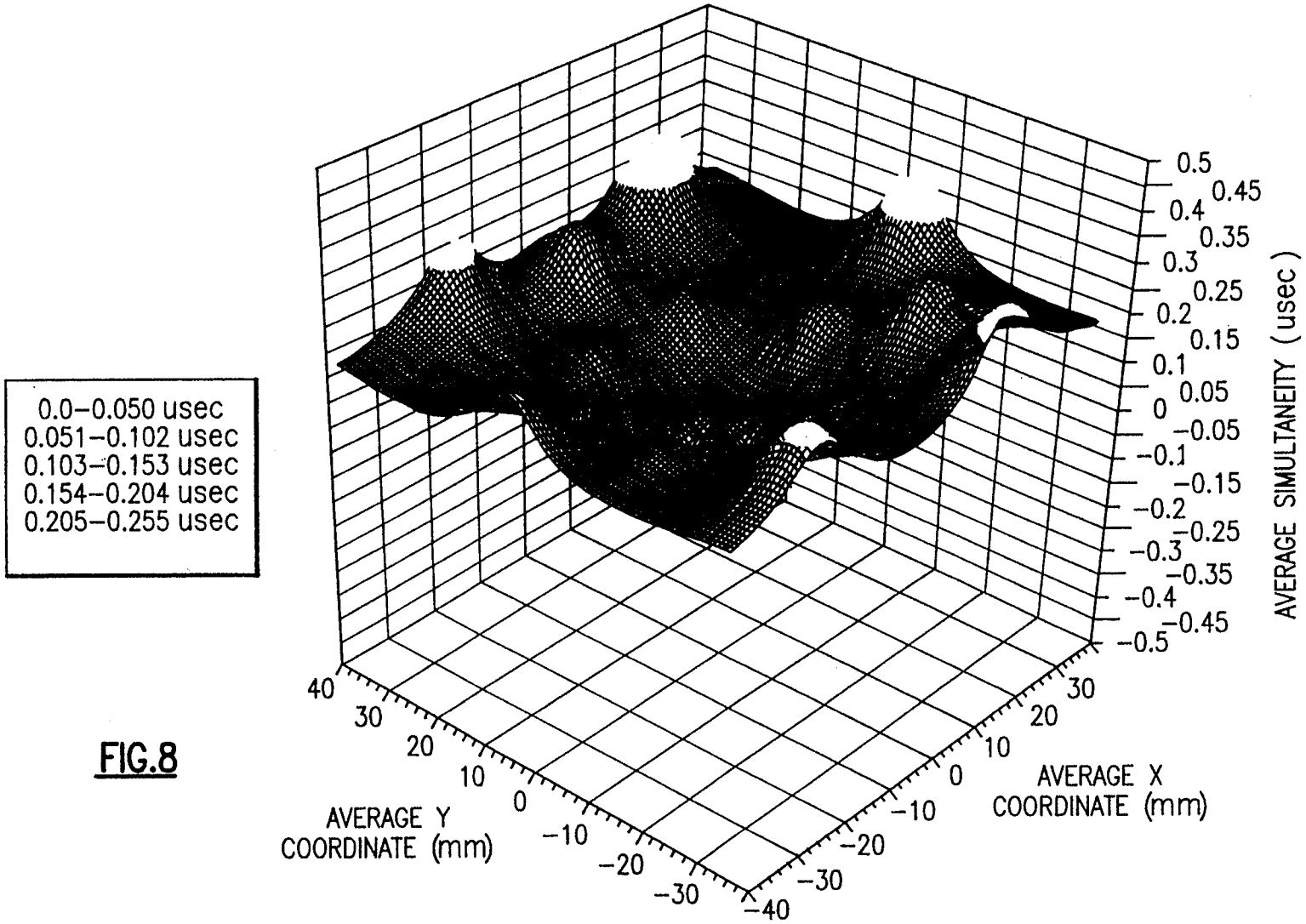
FIG. 8 is a graphical plot of data characteristic of a wave front generated by a conventional 4-fold axisymmetric multipoint detonation initiator.
Figure 9:
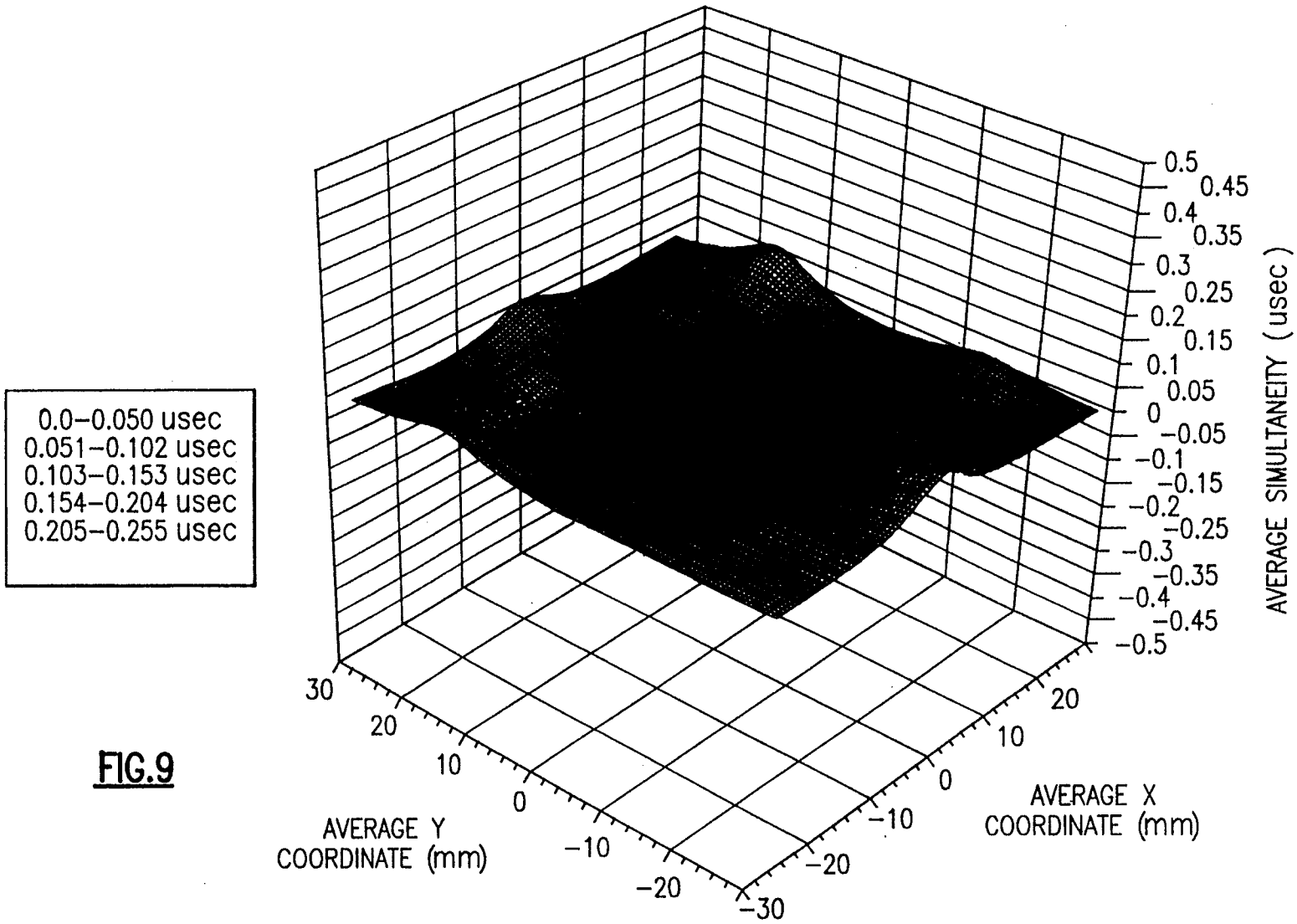
FIG. 9 is a graphical plot of data characteristic of a shock wave front generated by another preferred embodiment of a detonator device made in accordance with the first aspect of the instant invention.

In order to illustrate that a detonator device made according to the present invention is capable of generating a flatter shock wave front that requires less propagation time to achieve planarity than those generated by conventional detonator devices, the wave front generated by a three-fold axisymmetric multipoint detonation initiation device according to the embodiment of FIG. 1 (except that each cluster consisted of 9 through holes each) was compared to that generated by a conventional four-fold 32-point axisymmetric multipoint detonator device. Both devices were 9 centimeters in diameter and 0.953 centimeters thick. Three test runs were conducted with each aforesaid device under substantially identical conditions. Data was acquired in each test run using 24 discreet ionization probes connected to standard data acquisition and recording means and positioned in a probe plate affixed in a predetermined. spacial orientation at the base of a 4.4 centimeter thick LX-14 explosive billet. Each initiator was placed on the face of the explosive charge opposite the probe plate and the entire experimental assembly was positioned in a tube (to simulate conventional warhead confinement conditions). Each initiator device was then initiated by application of an electric charge to a RP-87 EBW device adjacent to the initiation point of each device, respectively. The data acquired by the experimental apparatus was analyzed to produce average simultaneity variance data. This data is depicted graphically in FIGS. 8 and 9. FIG. 8 depicts the average simulaeity variance produced by the shockwave generated by the 4-fold axisymmetric 32-point multipoint initiator device after the shockwave's transit through 4.4 centimeters of the LX-14 explosive charge. FIG. 9 depicts the average simultaneity variance produced by the shockwave generated by the three-fold axisymmetric 27-point (total) device according to the first aspect of the instant invention after transit of the shock wave through 4.4 centimeters of LX-14 explosive charge. As will be readily apparent to those skilled in the art, in light of the data graphically depicted in FIGS. 8 and 9, a three-fold axisymmetric detonator device made in accordance with the teachings of the present invention is clearly capable of generating a shock wave which flattens out faster and achieves greater planarity than a shock wave generated according to the prior art.

It is, therefore, evident that there has been provided in accordance with the present invention, a planar shock wave generator that fully satisfies both the aims and advantages hereinbefore set forth. While this invention has been described in conjunction with specific embodiments thereof, it is evident that many alternatives, modifications, and variations will be apparent to those skilled in the art. For example, although the utility of the instant invention has been discussed in connection with warhead applications, it will be evident that it may be used with commercial explosives applications, e.g., well-blasting, and the like. Accordingly, it is intended to embrace all such alternatives, modifications, and variations as fall within the spirit and broad scope of the appended claims.

What is claimed is:

1. A device for generating a substantially planar shockwave in a main explosive charge, and comprising, a substrate having two surfaces, one of said two surfaces having an initiation point, three identically configured clusters of 15 through-holes each, said clusters being symmetrically disposed in said substrate about said initiation point, a plurality of grooves of substantially equal length connecting said through-holes to said initiation point, and explosive material contained within said initiation point, through-holes, and said grooves.

2. A device according to claim 1, wherein at least one of said through-holes is conically-shaped.

3. A device according to claim 1, further comprising three identical main channels of substantially equal length connecting said initiation point to said plurality of grooves.

4. A device according to claim 1, further comprising three identical main channels of substantially equal length connecting said initiation point to said plurality of grooves.

5. A method for forming a detonator device having a predetermined number of through-holes grouped into three identical groups, a first, second, and third group, respectively, said groups being symmetrically disposed about an axis in one surface of a substrate and comprising a plurality of root holes and derived holes formed in said one surface, said axis defining the origin of a two-dimensional coordinate system for said one surface of said substrate, said coordinate system having an ordinate and an abscissa, said method comprising the steps of, a. forming, in said one surface of said substrate, said first group of through-holes, said formation of said first group comprising the steps of:

i. forming, in said one surface of said substrate and along said abscissa of said coordinate system thereof, said root holes so as to be substantially linearly disposed along said abscissa, each said root hole being assigned an order N from 0 to X, respectively, and being distanced away from said initiation point so as to substantially satisfy a first relationship, (2+4N) A, wherein A represents a predetermined distance;

ii. forming, in said one surface of said substrate, said derived holes, said derived holes corresponding to corresponding root holes of orders 0 to N-1 and respectively having an order M from 0 to Y related to said corresponding root holes, each said derived hole being distanced from said abscissa so as to substantially satisfy a second relationship, 4A (M+1) sin (T), wherein T equals ±60°, and also having a distance from said ordinate that substantially satisfies a third relationship, A(4N+2M+4); and b. forming said second and third groups of through-holes by successively respectively rotating said coordinate system by 120° about said initiation point and repeating step a for each of said second and third groups.

6. A detonator device made according to the method of claim 5.

7. A method according to claim 5, wherein X equals 3.

8. A method according to claim 5, wherein said substrate has a disk-like shape and A is greater than 0.396 mm.

9. A method according to claim 5, and further comprising, forming a plurality of substantially identical and equal-length grooves in said one surface from an initiation point to said plurality of through-holes.

10. A detonator device made according to the method of claim 9 having 45 through-holes.

11. A method according to claim 5, and further comprising, substantially filling said through-holes with an explosive substance.

12. A method according to claim 5, and further comprising, the formation of an initiation point substantially filled with an explosive material substantially at said origin of said coordinate system.

13. A method according to claim 9, and further comprising, the formation of three identical main channels of substantially equal length connecting said initiation point to said grooves.

14. A method according to claim 5, and further comprising, shaping said through-holes so that said through-holes have a substantially conical shape.

15. A detonator made according to the method of claim 14, wherein the number of through-holes is 45.

16. A detonator made according to the method of claim 13, wherein the number of through-holes is 45.

17. A detonator made according to the method of claim 12, wherein the number of through-holes is 45.

18. A method for producing a detonator device capable of generating a substantially planar shockwave, and comprising:

a. forming, in a substrate, a plurality of through-holes, said plurality of through-holes being formed so as to be configured into three identical clusters having 15 through-holes each, said clusters being symmetrically disposed in said substrate about an axis; and b. forming, in one side of said substrate, a plurality of grooves of substantially equal length connecting said through-holes to an initiation point disposed in said substrate coaxially with said axis.

19. A method according to claim 18, and further comprising, forming, in said one side of said substrate, three substantially identical and equal length main channels connecting said initiation point to each said cluster, respectively.

20. A method according to claim 18, and further comprising, substantially filling said initiation point, said through-holes, and said grooves with an explosive substance.

21. A detonator device made according to the method of claim 18.

* * * * *